US009238371B2

(12) United States Patent
Mizutani et al.

(10) Patent No.: US 9,238,371 B2
(45) Date of Patent: Jan. 19, 2016

(54) LIQUID JETTING APPARATUS

(71) Applicant: Brother Kogyo Kabushiki Kaisha, Nagoya-shi, Aichi-ken (JP)

(72) Inventors: Hiromitsu Mizutani, Ichinomiya (JP); Atsushi Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/601,519

(22) Filed: Jan. 21, 2015

(65) Prior Publication Data

US 2015/0202881 A1 Jul. 23, 2015

(30) Foreign Application Priority Data

Jan. 22, 2014 (JP) ..... 2014-009337

(51) Int. Cl.
*B41J 2/175* (2006.01)

(52) U.S. Cl.
CPC ..... *B41J 2/17563* (2013.01)

(58) Field of Classification Search
CPC ..... B41J 2/19; B41J 2/1404; B41J 2/17563; B41J 2002/14403; B41J 2/175
USPC ..... 347/54, 92, 93, 85; 210/498, 799
See application file for complete search history.

(56) References Cited

U.S. PATENT DOCUMENTS

| | | | | |
|---|---|---|---|---|
| 5,489,930 | A * | 2/1996 | Anderson | 347/71 |
| 5,610,645 | A * | 3/1997 | Moore et al. | 347/93 |
| 7,484,835 | B2 * | 2/2009 | Kim et al. | 347/67 |
| 7,878,638 | B2 * | 2/2011 | Akase | B41J 2/17513 347/92 |
| 8,201,928 | B2 * | 6/2012 | Gerner et al. | 347/71 |
| 8,240,833 | B2 * | 8/2012 | Owaki | B41J 2/17563 347/85 |
| 2009/0002469 | A1 * | 1/2009 | Imai et al. | 347/93 |
| 2010/0245435 | A1 | 9/2010 | Nakamura | |
| 2013/0033542 | A1 | 2/2013 | Nakazawa | |

FOREIGN PATENT DOCUMENTS

| | | |
|---|---|---|
| JP | 2010-221651 | 10/2010 |
| JP | 2013-35175 | 2/2013 |

* cited by examiner

*Primary Examiner* — Anh T.N. Vo
(74) *Attorney, Agent, or Firm* — Frommer Lawrence & Haug LLP

(57) ABSTRACT

There is provided a liquid jetting apparatus configured to jet liquid, including: a channel structure in which liquid channels including a plurality of nozzles are formed, and in one surface of which a plurality of supply ports are formed to communicate with the liquid channels; and a plurality of filters attached on the one surface of the channel structure to cover the plurality of supply ports. One of the plurality of filters is arranged to overlap partially with another filter of the plurality of filters which is located adjacent to the one of the plurality of filters, at an area between the plurality of supply ports.

10 Claims, 16 Drawing Sheets

(FIRST PROCESS)

(SECOND PROCESS)

(THIRD PROCESS)

(FOURTH PROCESS)

(FIFTH PROCESS)

LIQUID JETTING APPARATUS

CROSS REFERENCE TO RELATED APPLICATION

The present application claims priority from Japanese Patent Application No. 2014-009337, filed on Jan. 22, 2014, the disclosure of which is incorporated herein by reference in its entirety.

BACKGROUND

1. Field of the Invention

The present invention relates to liquid jetting apparatuses.

2. Description of the Related Art

Ordinary liquid jetting apparatuses are provided with a filter used to remove the foreign substances included in the supplied liquid. Conventionally, ink jet heads jetting ink or inks from nozzles are disclosed as the abovementioned liquid jetting apparatuses provided with the filter.

There is known an ink jet head which is provided with a channel structure (channel unit) in which ink channels are formed to include a plurality of nozzles. In a known channel structure, one filter is provided across the four supply ports. On the other hand, in another channel structure, four filters are provided individually over the four supply ports.

SUMMARY

When one filter is provided for a plurality of supply ports, the more the number of supply ports, the larger the size of the filter. Further, the larger the filter, the more difficult the handling at the time of attaching the filter onto the channel structure. As a result, the filter is not only more likely to undergo positional deviation but also more likely to have wrinkles and the like.

On the other hand, when a plurality of filters are provided individually for a plurality of supply ports, each filter has a smaller size, and thereby it becomes easier to handle the filters. However, in order to infallibly attach each filter around the supply port, it is necessary for each filter to have a sufficiently larger area than the supply port. Hence, it is necessary to secure a space between adjacent supply ports for attaching each of the filters. As a result, it is necessary to increase the distance between adjacent supply ports, thereby causing the apparatus to grow in size.

Accordingly, it is an object of the present teaching to facilitate downsizing of a channel structure while adopting a configuration of providing a plurality of filters for a plurality of supply ports of the channel structure.

According to an aspect of the present teaching, there is provided a liquid jetting apparatus configured to jet liquid, including:

a channel structure in which liquid channels including a plurality of nozzles are formed, and in one surface of which a plurality of supply ports are formed to communicate with the liquid channels; and a plurality of filters attached on the one surface of the channel structure to cover the plurality of supply ports, wherein one of the plurality of filters is arranged to overlap partially with another filter of the plurality of filters which is located adjacent to the one of the plurality of filters, at an area between the plurality of supply ports.

DESCRIPTION OF THE EMBODIMENT

Next, an embodiment of the present teaching will be explained.

<Schematic Configuration of a Printer>

Figure 1:
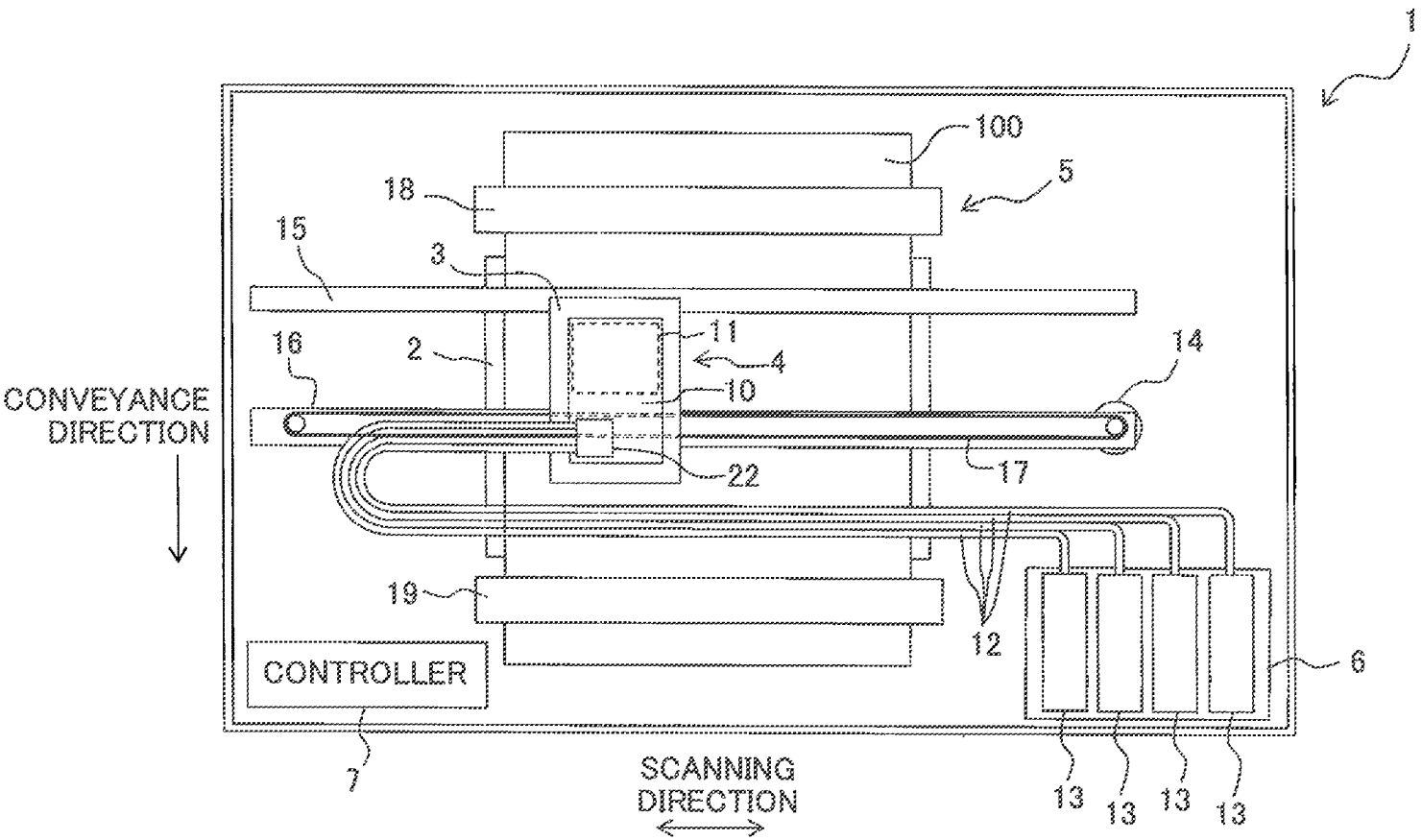
FIG. 1 is a schematic plan view of a printer according to an embodiment of the present teaching.

As depicted in FIG. 1, a printer 1 includes a platen 2, a carriage 3, an ink jetting apparatus 4, a conveyance mechanism 5, a holder 6, a controller 7, etc. Further, hereinbelow, the near side of the page of FIG. 1 is defined as "upper side" or "upside" of the printer 1, while the far side of the page is defined as "lower side" or "downside" of the printer 1.

A sheet of recording paper 100 which is a recording medium is located on the upper surface of the platen 2. Further, above the platen 2, two guide rails 15 and 16 are provided to extend parallel to a left-right direction of FIG. 1 (also referred to as a scanning direction).

The carriage 3 is fitted on the two guide rails 15 and 16, and is movable reciprocatingly in the scanning direction along the two guide rails 15 and 16 in a region facing the platen 2. Further, a drive belt 17 is connected to the carriage 3. A carriage drive motor 14 is provided to drive the drive belt 17. The drive belt causes the carriage 3 to move reciprocatingly in the scanning direction.

Figure 2:
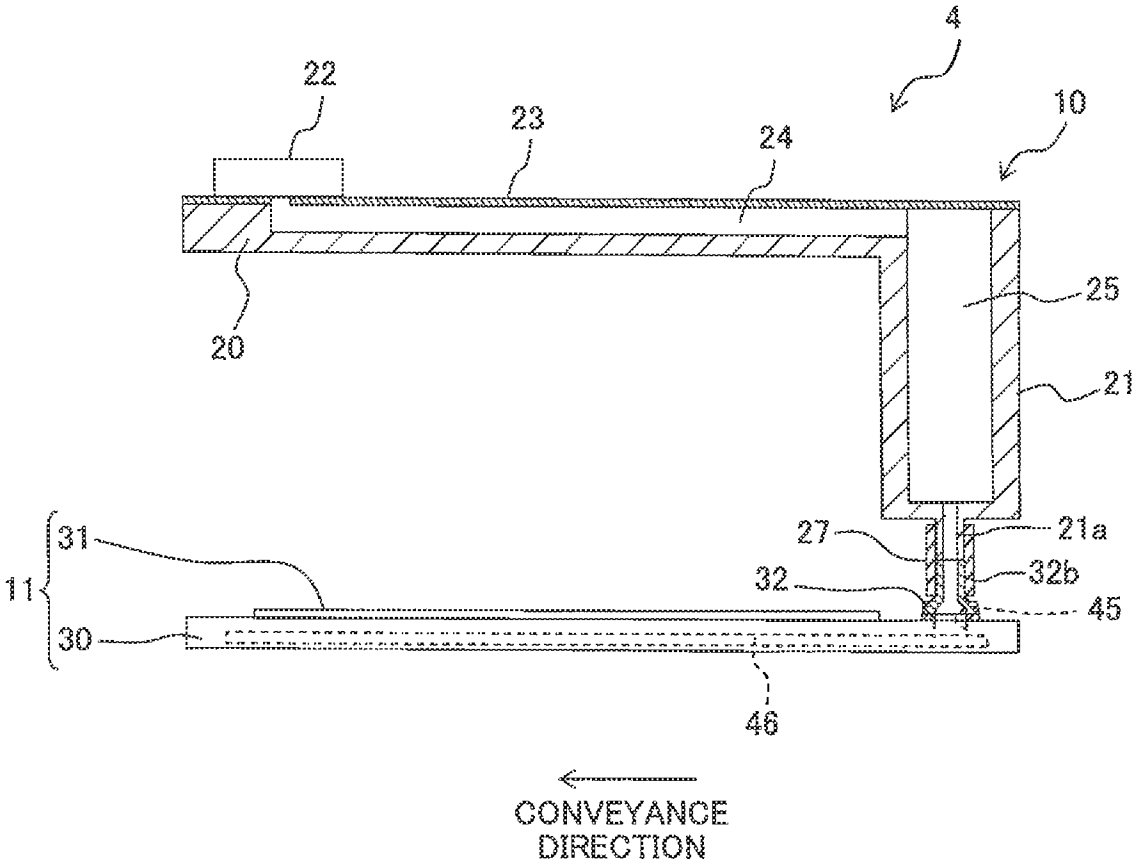
FIG. 2 is a cross-sectional view of an ink jetting apparatus including an ink jet head and a sub-tank.

The ink jetting apparatus 4 is mounted on the carriage 3. As depicted in FIGS. 1 and 2, the ink jetting apparatus 4 has a sub-tank 10 and an ink jet head 1. The sub-tank 10 is connected with the holder 6 through four tubes 12. In the holder 6, there are installed four ink cartridges 13 which are removable and respectively retain inks of four colors (black, yellow, cyan, and magenta). The four color inks are supplied via the tubes 12 from the four ink cartridges 13 installed in the holder 6, respectively.

The ink jet head 11 is provided below the sub-tank 10. The four color inks are supplied respectively from the sub-tank 10 to the ink jet head 11. A plurality of nozzles 44 for jetting the inks (see FIG. 3 and FIGS. 4A and 4B) are formed in a lower surface of the ink jet head 11. Detailed descriptions will be made later on specific configurations of the sub-tank 10 and ink jet head 11 of the ink jetting apparatus 4.

The conveyance mechanism 5 has two conveyance rollers 18 and 19 arranged to interpose the platen 2 therebetween in a conveyance direction. The conveyance mechanism 5 uses the two conveyance rollers 18 and 19 to convey the recording paper 100 positioned on the platen 2 in the conveyance direction.

The controller 7 includes a ROM (Read Only Memory), a RAM (Random Access Memory), an ASIC (Application Specific Integrated Circuit) including various control circuits, and the like. Subject to a program stored in the ROM, the controller 7 carries out various processes such as printing on the recording paper 100 with the ASIC. For example, in a printing process, based on a print command entered from an external device such as a personal computer or the like, the controller 7 controls the ink jet head 11 of the ink jetting apparatus 4, the carriage drive motor 14, etc., to print images and the like on the recording paper 100. In particular, the controller 7 alternately carries out an ink jet operation to jet the inks while moving the ink jet head 11 together with the carriage 3 in the scanning direction, and a conveyance operation to cause the conveyance rollers 18 and 19 to convey the recording paper 100 in the conveyance direction by a predetermined length.

<Details of the Ink Jetting Apparatus>

Next, the ink jetting apparatus 4 will be explained in detail. As depicted in FIG. 2, the ink jetting apparatus 4 has the sub-tank 10 and the ink jet head 11. Further, for simplification of the drawing, FIG. 2 depicts the ink jet head 11 in a lateral view and, for the internal ink channels, depicts only the primal parts thereof by way of dashed line.

<The Sub-Tank>

The sub-tank 10 has a damper portion 20 extending along a horizontal plane, and a connecting channel forming portion 21 extending vertically downward from the end of the damper portion 20 at the upstream side according to the conveyance direction. As depicted in FIGS. 1 and 2, a tube joint 22 is provided on the upper surface of the damper portion 20, and connected to the four tubes 12 linked with the holder 6. The damper portion 20 has a damper chamber 24 formed therein and covered by a synthetic resin film 23 to absorb pressure fluctuation of the ink. Further, FIG. 2 depicts only one damper chamber 24 but, in reality, the damper portion 20 includes four damper chambers 24 corresponding respectively to the four color inks.

The four color inks are supplied, respectively, to the four damper chambers 24 of the damper portion 20 through the four tubes 12 connected to the tube joint 22. The connecting channel forming portion 21 has a connecting channel 25 formed therein to communicate with the damper chamber 24 and extend in a vertical direction. Further, FIG. 2 also depicts only one connecting channel 25 but, in reality, four connecting channel 25 in respective communication with the four damper chambers 24 are arranged to align in the scanning direction (a direction vertical to the paper-surface of FIG. 2). Further, as depicted in FIG. 2, at the lower ends of the connecting channel forming portion 21, four cylindrical connecting portions 21*a* are provided to correspond to the four color inks. The four connecting portions 21*a* are connected with a channel unit 30 of the ink jet head 11 via cylindrical connecting members 27 made of rubber or the like, respectively.

<Ink Jet Head>

Figure 3:
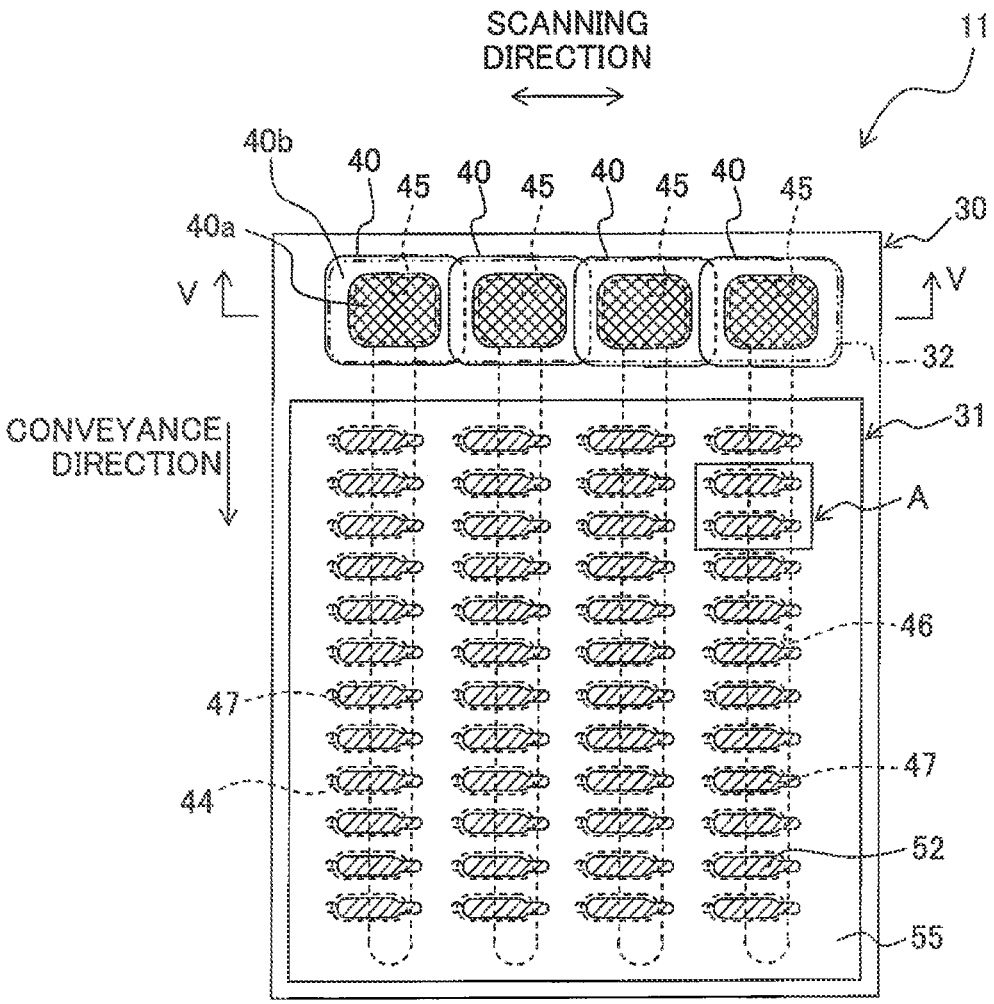
FIG. 3 is a plan view of the ink jet head.

In order to make it easy to understand an arrangement relationship of filters 40, FIG. 3 depicts only the outline of a connecting member 32 (see FIG. 5) arranged on the filters 40 by way of two-dot chain line. Further, FIG. 4B depicts the inks filling the inside of the channel unit 30 of the ink jet head 11 by way of the letter "L". The ink jet head 11 of this embodiment includes the channel unit 30 and a piezoelectric actuator 31.

As depicted in FIG. 4B, the channel unit 30 includes five stacked plates 35 to 39. Among the five plates 35 to 39, the lowermost plate 39 is the nozzle plate 39 in which a plurality of nozzles 44 are formed. On the other hand, in the other four upper plates 35 to 38, there are formed ink channels such as manifolds 46, pressure chambers 47 and the like in respective communication with the plurality of nozzles 44.

As depicted in FIG. 3, in the upper surface of the channel unit 30, four ink supply ports 45 are formed to align in the scanning direction. Further, the four filters 40 are attached on the upper surface of the channel unit 30 to cover the four ink supply ports 45 respectively. Further, the connecting member 32 is provided on the four filters 40 to have four cylindrical connecting portions 32*b*. As depicted in FIG. 2, the four ink supply ports 45 are connected with the four connecting portions 21*a* of the sub-tank 10 via the connecting member 32. Then, the four ink supply ports 45 are supplied respectively with the four color inks from the sub-tank 10. Further, the above filters 40 and the connecting member 32 will be explained later in detail.

The channel unit 30 internally has the four manifolds 46 respectively extending in the conveyance direction. The four manifolds 46 are connected to the four ink supply ports 45.

Further, the channel unit 30 has the plurality of nozzles 44 opening at its lower surface, and the plurality of pressure chambers 47 arranged in its upper surface. As depicted in FIG. 3, four nozzle rows are formed in the channel unit 30 to correspond to the four manifolds 46. The nozzle rows respectively have the plurality of nozzles 44 arrayed along the manifolds 46. In the same manner as the nozzles 44, the plurality of pressure chambers 47 are also arrayed along the four manifolds 46 to form four pressure chamber rows.

As depicted in FIG. 4B, each of the pressure chambers 47 has its one end in communication with the corresponding manifold 46, and its other end in communication with the corresponding nozzle 44. Then, as depicted in FIG. 4B by way of the arrow, inside the channel unit 30, a plurality of individual channels are formed to branch from each of the manifolds 46, pass through the pressure chambers 47, and come down to the nozzles 44.

Figure 4A:
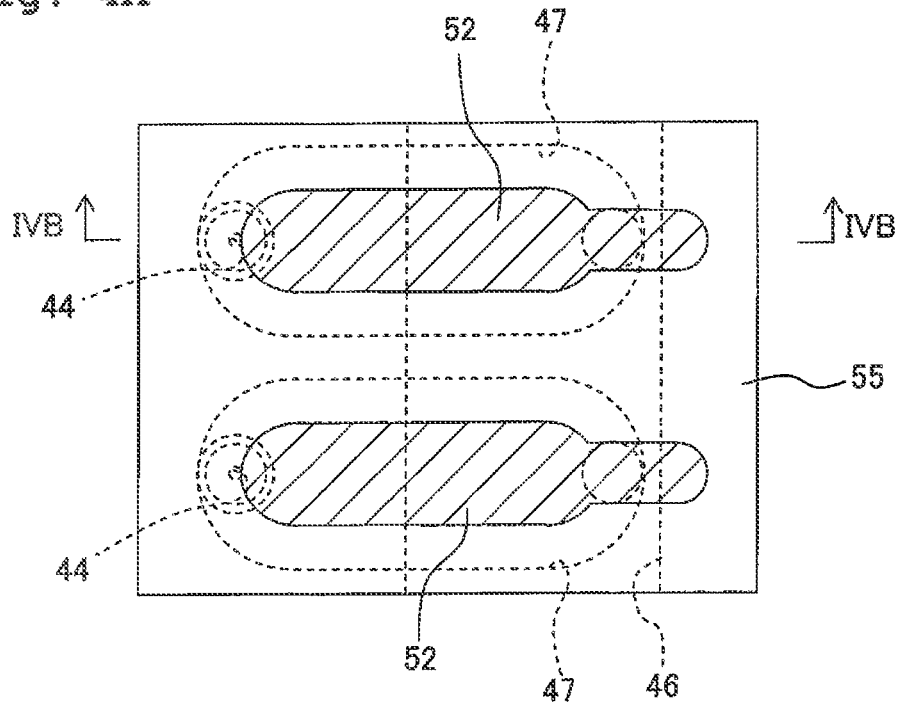
FIG. 4A is an enlarged view of part A of FIG. 3.
Figure 4B:
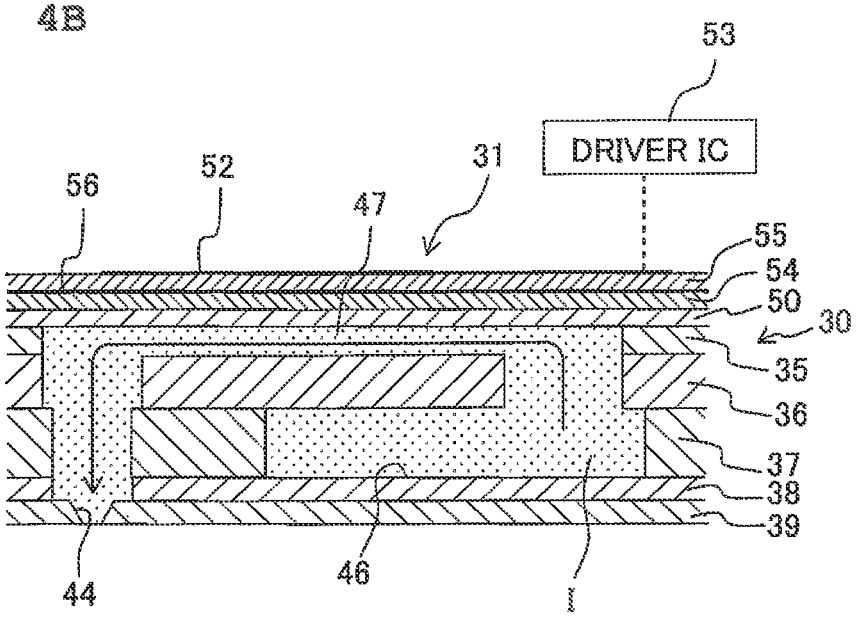
FIG. 4B is a cross-sectional view along the line IVB-IVB of FIG. 4A.

As depicted in FIG. 3 and FIGS. 4A and 4B, the piezoelectric actuator 31 includes an ink sealing film 50, piezoelectric layers 54 and 55, a plurality of individual electrodes 52, and a common electrode 56. The ink sealing film 50 is joined to the upper surface of the channel unit 30 to cover the plurality of pressure chambers 47. The two piezoelectric layers 54 and 55 are stacked on the upper surface of the ink sealing film 50. The plurality of individual electrodes 52 are arranged on the upper surface of the upper piezoelectric layer 55 to face the plurality of pressure chambers 47 respectively. The common electrode 56 is arranged between the two piezoelectric layers 54 and 55 and across the plurality of pressure chambers 47.

The plurality of individual electrodes 52 are connected with a driver IC 53 through wiring members (not depicted).

The driver IC 53 receives a signal from the controller 7 (see FIG. 1) to apply a drive voltage to each of the plurality of individual electrodes 52. When the drive voltage is applied to any of the individual electrodes 52, a piezoelectric strain occurs in such a portion of the upper piezoelectric layer 55 as sandwiched by that individual electrode 52 and the common electrode 56 and, as a result, the two piezoelectric layers 54 and 55 deform to project toward the corresponding pressure chamber 47. At this time, the pressure chamber 47 changes in volume to impart jet energy to the ink inside the pressure chamber 47. Therefore, the ink is jetted from the nozzle 44 in communication with the pressure chamber 47.

<Details of the Filters and the Connecting Member>

Next, an explanation will be made on the filters 40 provided over the ink supply ports 45 of the channel unit 30, and the connecting member 32 provided on the filters 40.

Figure 5:
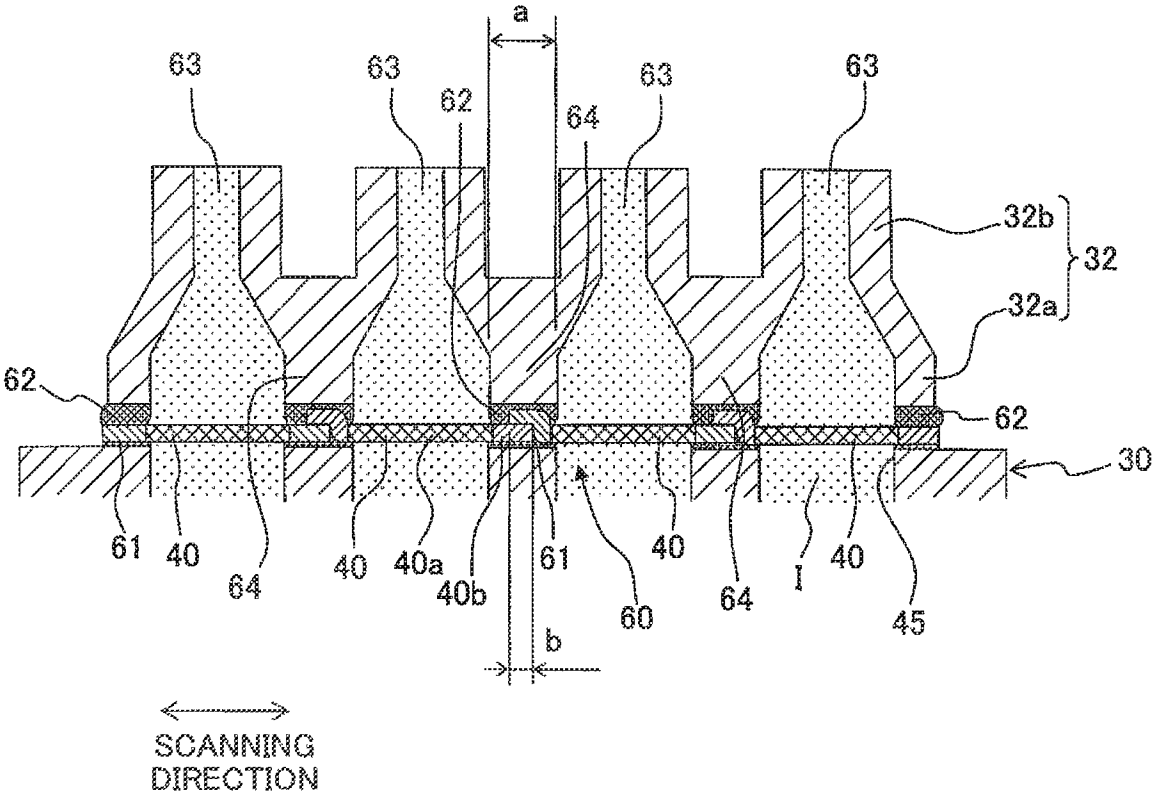
FIG. 5 is a cross-sectional view along the line V-V of FIG. 3.

As depicted in FIGS. 3 and 5, the four filters 40 are attached on the upper surface of the channel unit 30 to align along the scanning direction and cover the four ink supply ports 45 respectively and individually. That is, the ink supply ports 45 and the filters 40 have a one-to-one relationship. The filters 40 are, for example, plate-like members formed of a metal and sized slightly larger than the ink supply ports 45. Further, each of the filters 40 has a central portion where an opening portion 40*a* is formed with numerous holes to filter the ink. The opening portions 40*a* of the filters 40 are not limited to any particular configuration and method of manufacturing but, for example, it is possible to adopt a known filter such as an electroformed filter made of nickel or the like, a sintered filter of short metallic fiber, a mesh filter made of a metallic mesh or the like, etc. Further, the opening portions 40*a* are sized a little larger than the ink supply ports 45 such that each of the opening portions 40*a* covers the corresponding ink supply port 45 entirely and infallibly even if the filters 40 undergo a little positional deviation from the ink supply ports 45 when attaching the filters 40 onto the channel unit 30. Further, surrounding portions 40*b* of the filters 40 around the opening portions 40*a* are the portions which are attached to the channel unit 30 with an adhesive 61.

Between any two adjacent filters 40 in the scanning direction, the surrounding portions 40*b* around the opening portions 40*a* overlap each other's end portions in the scanning direction. Hereinafter, the portions where two filters 40 partially overlap are referred to as overlap portions 60. Further, the four filters 40 aligning in the scanning direction are attached onto the channel unit 30 sequentially from the left side of FIG. 5. That is, the leftmost filter 40 is in entire contact with the channel unit 30. On the other hand, the other filters 40 overlap with each other with the left end portion of one filter 40 riding on the right end portion of another filter 40 positioned on the left side.

As depicted in FIGS. 3 and 5, the connecting member 32 is arranged on the four filters 40. The connecting member 32 has a base portion 32*a*, and the four cylindrical connecting portions 32*b* which align in the scanning direction and project upward from the base portion 32*a*. The base portion 32*a* is joined onto the upper surfaces of the four filters 40 with an adhesive 62. As depicted in FIG. 2, the four connecting portions 32*b* are connected respectively with the four connecting portions 21*a* of the sub-tank 10 via the cylindrical connecting members 27 made of rubber or the like.

In the connecting member 32, from the four connecting portions 32*b* in the upper part to the base portion 32*a* in the lower part, four supply channels 63 are respectively formed to vertically penetrate through the connecting member 32. The four supply channels 63 align in the scanning direction. Further, in the base portion 32*a*, three partition wall portions 64 are formed to respectively partition the four supply channels 63. The horizontal cross-section of a lower half of each supply channel 63 formed in the base portion 32*a* is almost equal to the ink supply port 45. On the other hand, the horizontal cross-section of an upper half of each supply channel 63 formed in the base portion 32 is smaller than the ink supply port 45. That is, each supply channel 63 has a larger cross-sectional area in the lower half than in the upper half. In other words, between the upper half and the lower half of each supply channel 63, there is a portion in an inverse tapered shape of which cross-sectional area increases toward the downstream side.

When the base portion 32*a* is joined onto the four filters 40, the lower end surface of each partition wall portion 64 of the base portion 32*a* is joined to the corresponding overlap portion 60 between two adjacent filters 40 through the adhesive 62. Further, as depicted in FIG. 5, a width 'a' of the lower end surface in the scanning direction is greater than a width 'b' of the overlap portions 60 between two filters 40 in the scanning direction.

The inks supplied from the sub-tank 10 pass through the supply channels 63 inside the connecting member 32 and, furthermore, move past the filters 40 below the connecting member 32 to flow into the ink supply ports 45. On this occasion, foreign substances included in the inks are filtrated by the filters 40 whereby the foreign substances are impeded from flowing into the channel unit 30 so as to prevent the foreign substances from clogging the nozzles. Further, whereas the diameter of the nozzles 44 is approximately 20 μm, the diameter of the plurality of holes provided in the opening portions 40*a* of the filters 40 is approximately 10 μm to 11 μm. In the filters 40 of this embodiment, the holes are formed respectively to locate at the vertices of equilateral triangles (side length: 20 μm to 25 μm) which are bedded without interspace. Further, the thickness of the filters 40 is approximately 10 μm. Because the plurality of holes of the filters 40 are sufficiently smaller in diameter than the nozzles 44, it is possible to impede the foreign substances of such sizes as to clog the nozzles from flowing into the channel unit 30. However, the dimensions of the filters 40 and the nozzles 44 are merely exemplary, and the present teaching is not limited to those dimensions.

However, in order to infallibly attach the filters 40 to the channel unit 30, the surrounding portions 40*b* around the opening portions 40*a* need to have a certain size or larger for the attachment on the channel unit 30. Hence, if the four filters 40 are ordinarily arranged to align in the scanning direction, then a large area is needed on the upper surface of the channel unit 30 for arranging the filters 40. In this regard, each of the four filters 40 is arranged to overlap partially with another filter 40 adjacent in the scanning direction. Therefore, it is possible to lessen the space for arranging the filters 40 of the channel unit 30 by the area of the overlap portions 60 of every two adjacent filters 40. In particular, it is possible to lessen the intervals between the four ink supply ports 45 covered respectively by the four filters 40. Therefore, it is possible to downsize the channel unit 30.

Further, when the connecting member 32 is joined to the filters 40 with the adhesive 62, the partition wall portions 64 are joined to the overlap portions 60 of the filters 40. Here as depicted in FIG. 5, the width 'a' of the partition wall portions 64 according to the scanning direction is greater than the width 'b' of the overlap portions 60 between two filters 40. Further, because two adjacent filters 40 overlap, the overlap portions 60 are thicker than the other portions. Therefore, when the partition wall portions 64 are joined to the filters 40 with the adhesive 62 while being pressed against the channel unit 30, between the partition wall portions 64 and the overlap portions 60 of the filters 40, the adhesive 62 is strongly pressed locally; thus, it is possible to tightly join the partition wall portions 64 with the overlap portions 60 of the filters 40. Further, when the connecting member 32 is joined, the surplus adhesive 62 flowing out of the overlap portions 60 escapes into the space between the partition wall portions 64, and the overlap portions 60 of the surrounding portions 40*b*. Then, with the escaped adhesive 62, the partition wall portions 64 are also joined with the overlap portions 60 of the surrounding portions 40*b* of the filters 40. In the above manner, the adhesion strength increases between the filters 40, and the partition wall portions 64 of the connecting member 32. For example, the width 'a' is 6 mm. For example, the width 'b' is 2 mm.

Further, when the connecting member 32 is attached, because the surplus adhesive 62 spreads around from the overlap portions 60, it is usually necessary to form an escape part such as a groove or the like in each of the filters 40 for the surplus adhesive 62 to escape thereinto. In this embodiment, however, as described above, because it is possible to let the surplus adhesive 62 escape into the space between the partition wall portions 64, and the overlap portions 60 of the surrounding portions 40*b* of the filters 40, it is not necessary to particularly provide the escape part for the adhesive 62 in each of the filters 40, and thus it is possible to downsize the filters 40. By virtue of this, it is possible to further lessen the filter arrangement area of the channel unit 30. Further, the parts between the filters 40 and the partition wall portions 64 are sealed with the surplus adhesive 62 flowing out around the overlap portions 60, such that it becomes possible to reliably prevent ink leak.

Further, if the width 'a' of the partition wall portions 64 in the scanning direction is small, then there is a large difference in the cross-sectional area along the portion in the inverse tapered shape. Therefore, the inks are more likely to stagnate on the upstream side of the filters 40, thereby becoming more likely to retain air. In this embodiment, however, because the width 'a' of the partition wall portions 64 is greater than the width 'b' of the overlap portions 60 of the filters 40, such ink stagnation as described above is less likely to occur.

In the embodiment explained above, the ink jetting apparatus 4 corresponds to the liquid jetting apparatus of the present teaching. The sub-tank 10 corresponds to the liquid supply portion of the present teaching. The channel unit 30 corresponds to the channel structure of the present teaching. The connecting member 32 corresponds to the connecting portion of the present teaching.

Next, explanations will be made on several modifications which have applied various changes to the above embodiment. However, the same reference signs are assigned to the components identical or similar in configuration to those in the above embodiment, and any explanation therefor will be omitted as appropriate.

<First Modification>

In the above embodiment, as depicted in FIGS. 3 and 5, the four filters 40 are overlapped sequentially from one side in the scanning direction (from the left side of the figures) to be arranged on the channel unit 30. In this configuration, however, when the four filters 40 are attached onto the channel unit 30 with the adhesive, the four filters 40 are overlapped one by one. Therefore, a process is necessary to arrange as many filters 40 as needed, which takes some effort.

Figure 6:
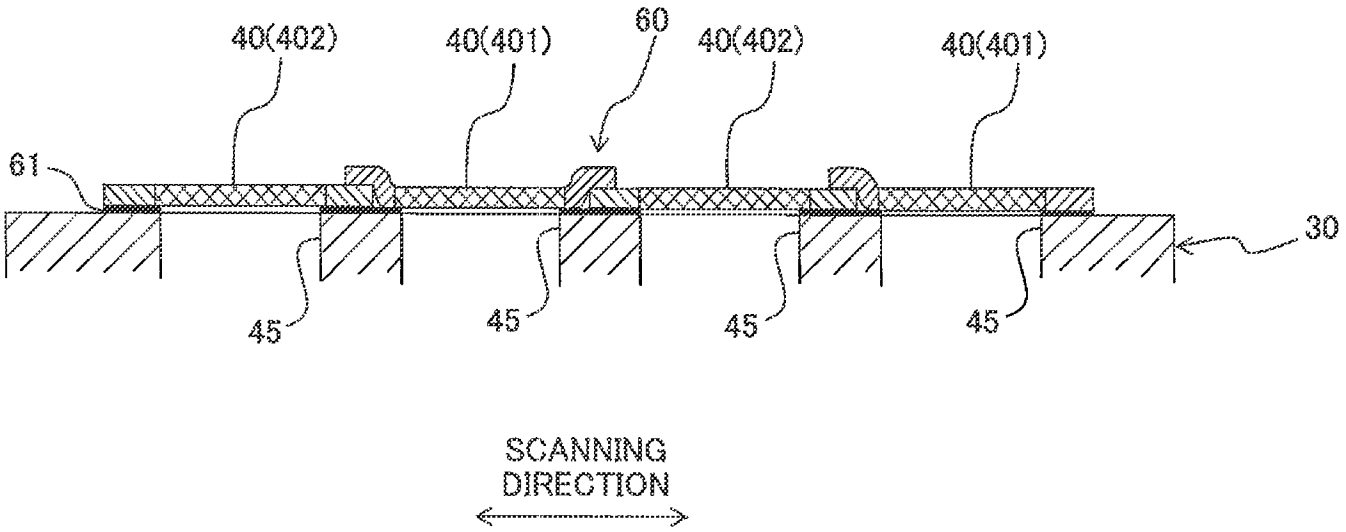
FIG. 6 is a cross-sectional view of four filters according to a first modification of the embodiment.

In contrast to the above, as depicted in FIG. 6, it is contrived that the four filters 40 can be arranged by carrying out a filter arrangement process twice. In FIG. 6, for the convenience of explanation, the four filters 40 are divided into two first filters 401 and two second filters 402. The first filters 401 and the second filters 402 are alternated to align in the scanning direction. End portions of the first filters 401 in the scanning direction ride on the adjacent second filters 402 to overlap therewith. Conversely, end portions of the two second filters 402 never ride on the first filters 401 but are always under the first filters 401. By adopting this configuration of FIG. 6, as depicted below, it is possible to attach the four filters 40 onto the channel unit 30 by carrying out the filter arrangement process twice.

<First Process>

Figure 7A:
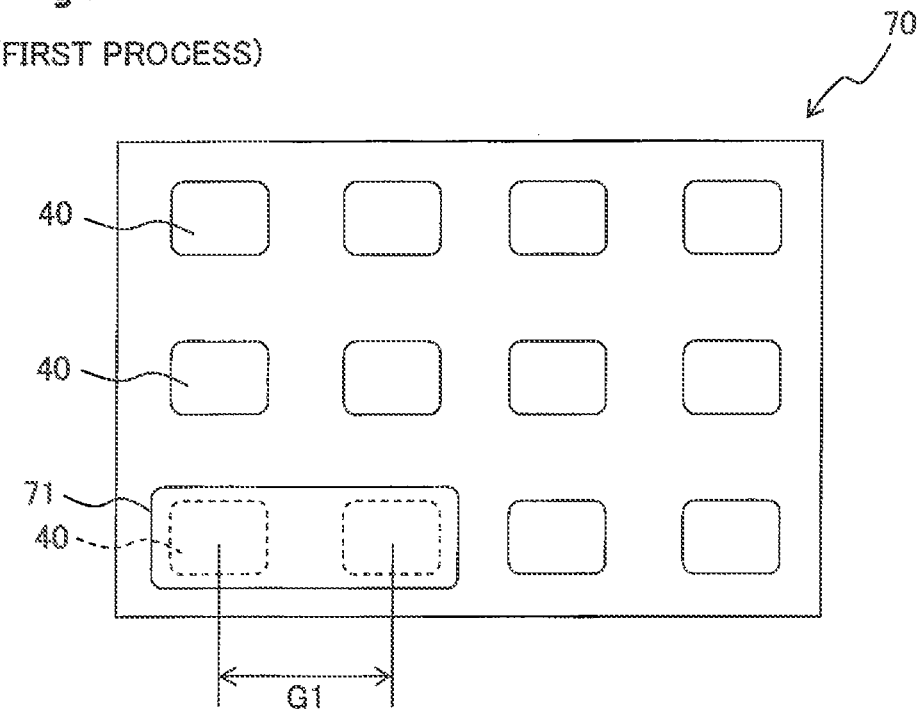
FIGS. 7A and 7B depict first and second processes in attaching the filters of FIG. 6 to a channel unit.

As depicted in FIG. 7A, from a filter placement tray 70 in which a number of filters 40 are placed, two filters 40 are sucked and held by a suction holder 71. As the suction holder 71, it is possible to utilize, for example, a suction holder making use of vacuum suction, or a magnetic suction holder making use of magnetic force. The suction holder 71 is configured to hold and move two filters 40 while keeping the interval between the two filters 40.

<Second Process>

Figure 7B:
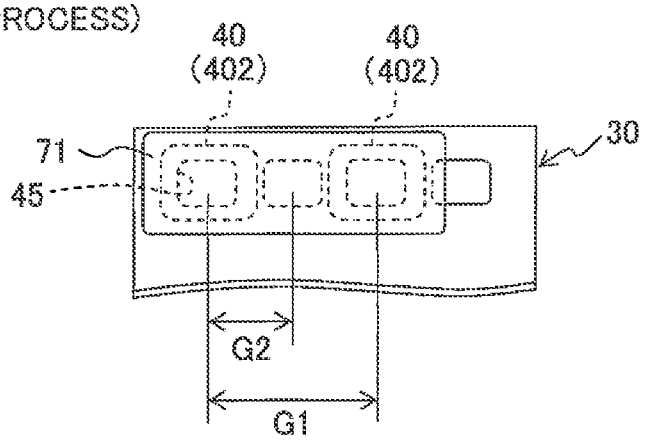

As depicted in FIG. 7B, the suction holder 71 holding the two filters 40 is moved onto the upper surface of the channel unit 30. Then, on the upper surface of the channel unit 30 to which the thermosetting adhesive 61 is transferred, the two filters 40 are released from the suction holder 71, and arranged on the upper surface of the channel unit 30. Here, a placement interval G1 for the filters 40 in the filter placement tray 70 as depicted in FIG. 7A is twice as long as an arrangement interval G2 for the ink supply ports 45 of the channel unit 30 as depicted in FIG. 7B. Hence, the two filters 40 are arranged on the first ink supply port 45 from the left and on the third ink supply port 45 from the left, respectively. Further, the two filters 40 arranged in the process 2 become the second filters 402, respectively.

<Third Process>

Figure 8A:
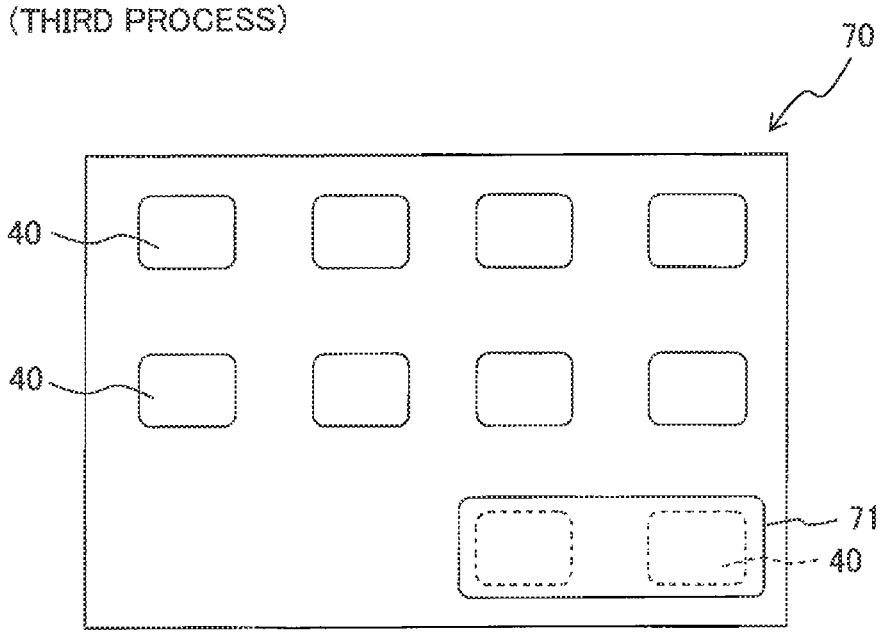
FIGS. 8A and 8B depict third and fourth processes in attaching the filters of FIG. 6 to the channel unit.

As depicted in FIG. 8A, in the same manner as the process 1, from the filter placement tray 70, other two filters 40 are held by the suction holder 71.

<Fourth Process>

Figure 8B:
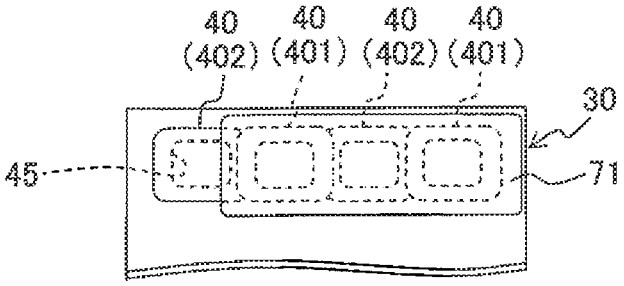

As depicted in FIG. 8B, the suction holder 71 holding the two filters 40 is moved onto the upper surface of the channel unit 30. Then, the two filters 40 are released from the suction holder 71, and arranged on the second ink supply port 45 from the left and on the fourth ink supply port 45 from the left, respectively. Further, at this time, the two filters 40 are caused to ride on the end portions of the two filters 40 arranged previously to overlap therewith. Further, the two filters 40 arranged in the process 4 become the first filters 401, respectively.

<Fifth Process>

Figure 9:
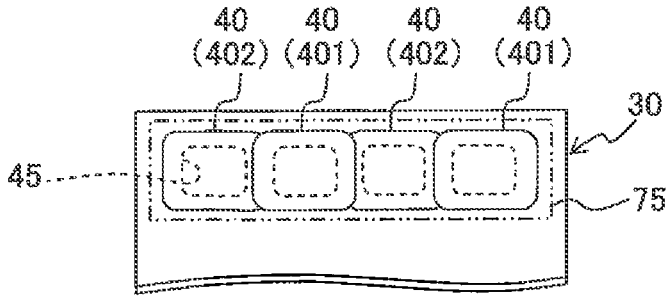
FIG. 9 depicts a fifth process in attaching the filters of FIG. 6 to the channel unit.

As depicted in FIG. 9, the four filters 40 are pressed from upper side while being heated with a common heater 75. Further, in order to simplify the drawing, FIG. 9 depicts the heater 75 by way of two-dot chain line. By virtue of this, the thermosetting adhesive 61 is set to join the four filters 40 to the channel unit 30.

In this manner, it is possible to arrange the four filters 40 by carrying out the filter arrangement process twice (the second process and the fourth process), thereby allowing for reduction of the number of processes. Further, as understood easily from the above explanation, regardless of the number of filters 40, the filter arrangement process is finished after being carried out twice. Therefore, it is especially effective for a large number of filters 40.

<Second Modification>

Figure 10A:
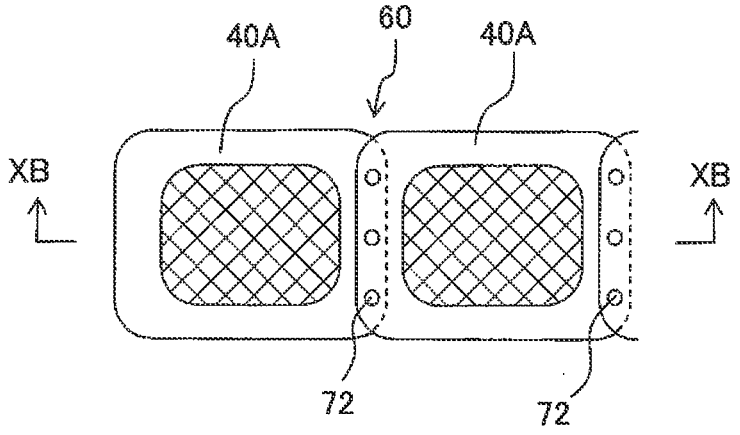
FIG. 10A is a plan view depicting filters according to a second modification.
Figure 10B:
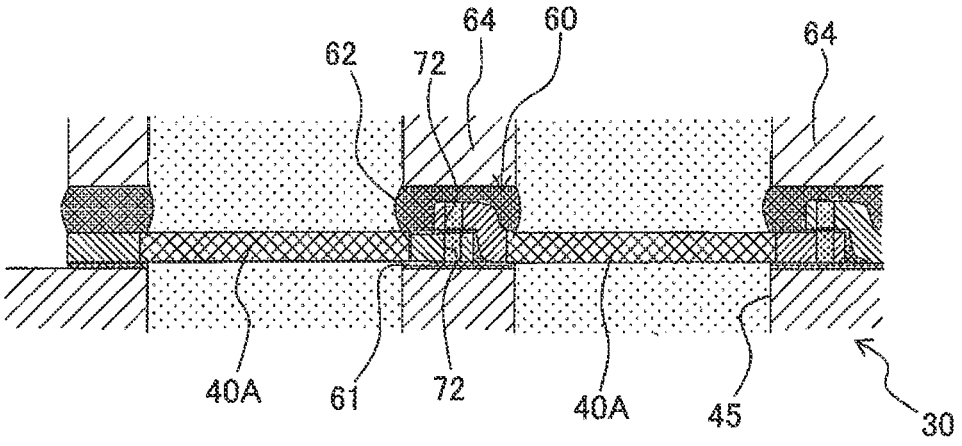
FIG. 10B is a cross-sectional view along the line XB-XB of FIG. 10A.

Through holes may be formed in the overlap portions of adjacent filters. As depicted in FIGS. 10A and 10B for example, three through holes 72 are formed in an end portion of each filter 40A constituting the overlap portion 60. In this configuration, when the filters 40A and the channel unit 30 or the filters 40A and the connecting member 32 are joined with the adhesive, it is possible to let the surplus adhesive 61 (62) escape into the space in the through holes 72. Further, because the through holes 72 are also filled with the adhesive 61 (62), the adhesion area increases and thus the adhesion strength also increases. For example, the diameter of the through hole is 1 mm.

Further, because the through holes 72 are provided in both of the two filters 40A overlapping in the overlap portion 60, with the adhesive 61 (62) flowing respectively into the three through holes 72, the two filters 40A, the connecting member 32, and the channel unit 30 are joined more tightly. Further, from the through holes 72 penetrating through each filter 40A, the adhesive 61 (62) also comes into somewhere between the two overlapped filters 40A; therefore, the adhesion strength also increases between the filters 40A. Further, the through holes 72 may also be formed in such an end portion of each filter 40A as not to constitute the overlap portion 60. For example, the same through holes 72 as in the overlap portion 60 may also be formed in the left end portion of the filter 40A on the left side in FIG. 10A.

Figure 11A:
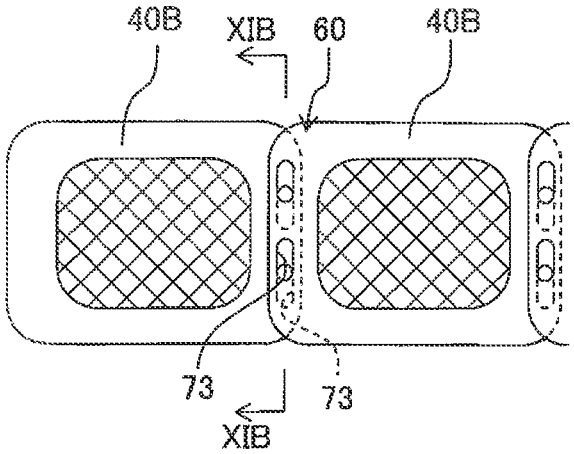
FIG. 11A is a plan view depicting other filters according to the second modification.
Figure 11B:
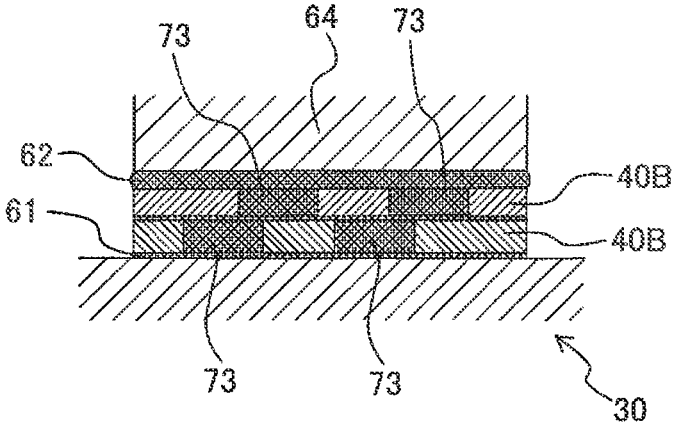
FIG. 11B is a cross-sectional view along the line XIB-XIB of FIG. 11A.

Further, as depicted in FIGS. 11A and 11B, long through holes 73 are formed respectively in two filters 40B overlapping in the overlap portion 60. The two through holes 73 formed respectively in the two filters 40B undergo positional deviation in a longitudinal direction of the holes. By virtue of this, in a thickness direction of the filters 40B, the two through holes 73 partially overlap. In this configuration, the space formed in the two through holes 73 has a complex shape. Therefore, when the adhesive flows into the above space, the adhesion area further increases; that is, because a so-called anchor effect is brought about, the adhesion strength further increases. Further, the through holes 73 may also be formed in such an end portion of each filter 40B as not to constitute the overlap portion 60. For example, the same through holes 73 as in the overlap portion 60 may also be formed in the left end portion of the filter 40B on the left side in FIG. 11A.

Further, the two through holes formed respectively in the two filters need not overlap in the thickness direction of the filters. Further, the through holes need not necessarily be formed in both of the two filters overlapping in the overlap portion, but may be formed only in one of the filters.

Figure 12A:
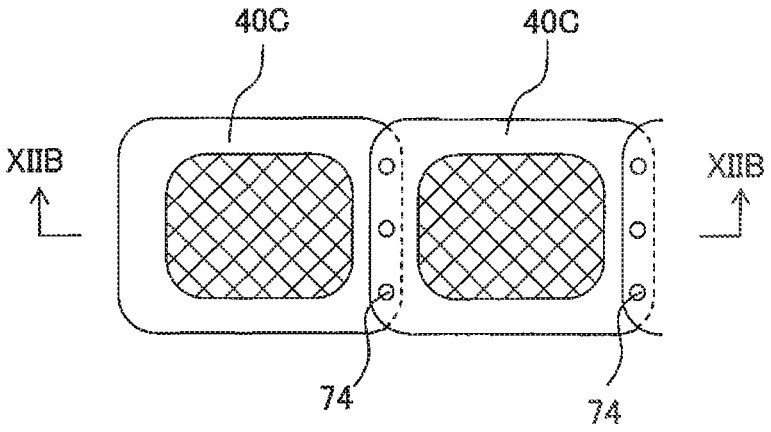
FIG. 12A is a plan view depicting still other filters according to the second modification.
Figure 12B:
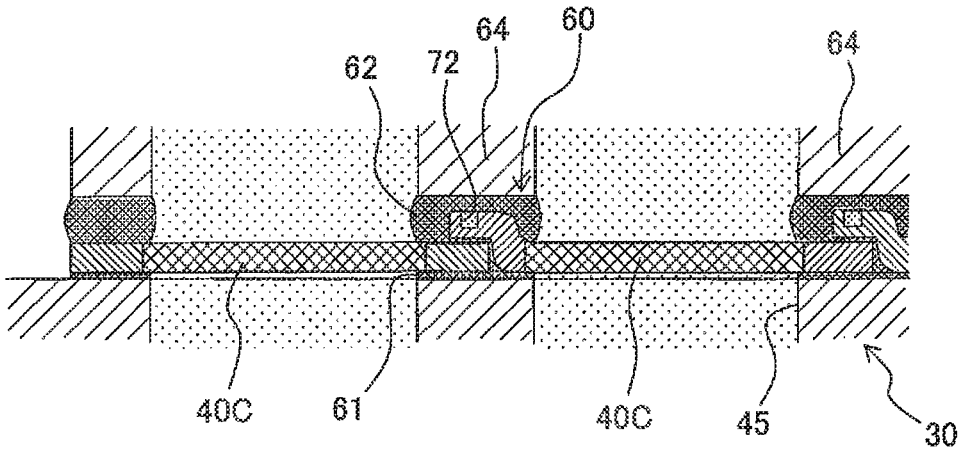
FIG. 12B is a cross-sectional view along the line XIIB-XIIB of FIG. 12A.

Further, as depicted in FIGS. 12A and 12B, instead of the through holes 72 and 73 mentioned above, recesses 74 may be formed in two filters 40C overlapping in the overlap portion. In this configuration, when the filters 40C and the channel unit 30 or the filters 40C and the connecting member 32 are joined with the adhesive 61 (62), it is possible to let the surplus adhesive 61 (62) escape into the space in the recesses 74. Further, the recesses 74 may also be formed in such an end portion of each filter 40C as not to constitute the overlap portion 60. For example, the same recesses 74 as in the overlap portion 60 may also be formed in the left end portion of the filter 40C on the left side in FIG. 12A. For example, the diameter of the recess is 1 mm.

<Third Modification>

Figure 13:
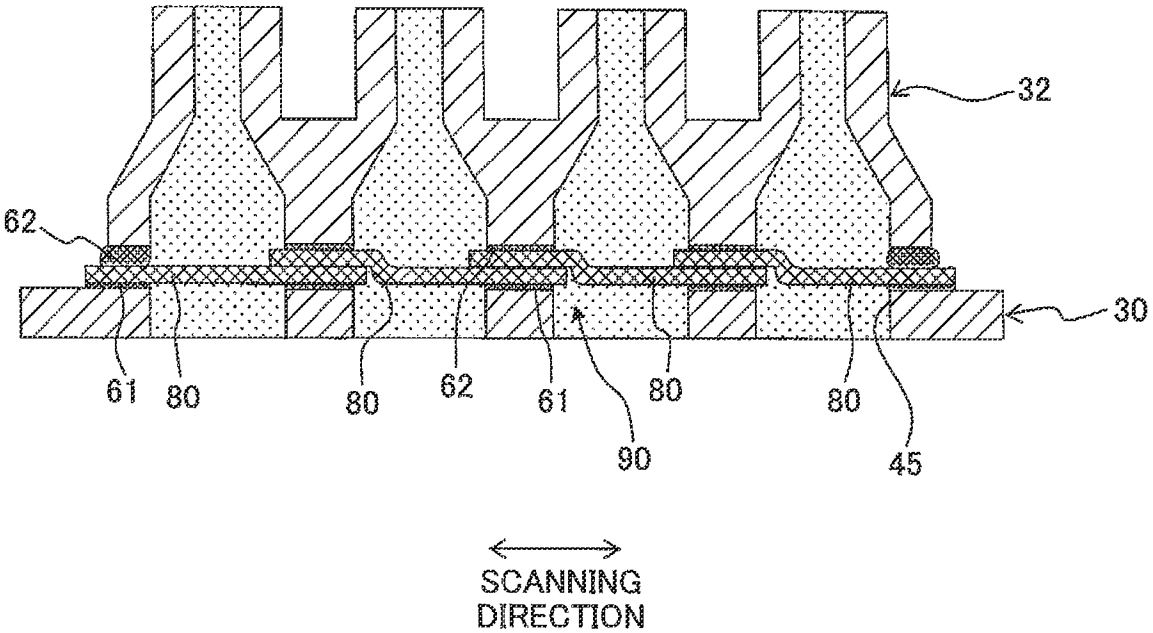
FIG. 13 is a cross-sectional view of filters and a connecting member according to a third modification.

In the above embodiment, any two adjacent filters 40 overlap in the surrounding portions 40*b* thereof around the opening portions 40*a*. However, the present teaching is not limited to such a configuration. As depicted in FIG. 13, for example, corresponding opening portions of filters 80 may overlap. Especially, if the filters 80 are mesh filters, then because almost the entire area of the filters 80 is the opening portion, it is inevitably configured to overlap the corresponding opening portions of adjacent filters 80.

Further, in the above configuration, because overlap portions 90 of any two filters 80 are the portions where those corresponding opening portions overlap, there is no problem even if the overlap portions 90 overlap with partial areas of the ink supply ports 45 as depicted in FIG. 13. In such a case, the partial areas of the ink supply ports 45 face the thicker overlap portions 90 of the filters 80 while the other areas of the ink supply ports 45 face the less thick portions of the filters 80 other than the overlap portions 90. In this configuration, because the less thick areas of the filters 80 have a sunken shape with respect to the thicker areas of the filters 80, comparatively large-sized foreign substances are more likely to be trapped concentrically in these sunken portions. That is, by trapping large-sized foreign substances in the portions of the filter 80 other than the overlap portions 90, it is possible to make the large foreign substances less likely to clog the overlap portions 90 of the filters 80.

Further, in the overlap portions 90 of the filters 80 of FIG. 13, because two filters 80 overlap to form the thicker portions than the other portions, there is a larger flow resistance. Especially, if the overlap portions 90 largely hang over and overlap with the ink supply ports 45 as much as half or more, for example, then the filters 80 will have a considerable large flow resistance. Therefore, between two partially overlapped filters, at least one filter may be configured to have, in the opening portion, a higher mesh coarseness (that is, aperture ratio) of the area constituting the overlap portion 90 than the mesh coarseness (that is, aperture ratio) of the other area than for the overlap portion 90. For example, the aperture ratio of the overlap portion 90 is 80%, and the aperture ratio of the other area is 60%.

Figure 14:
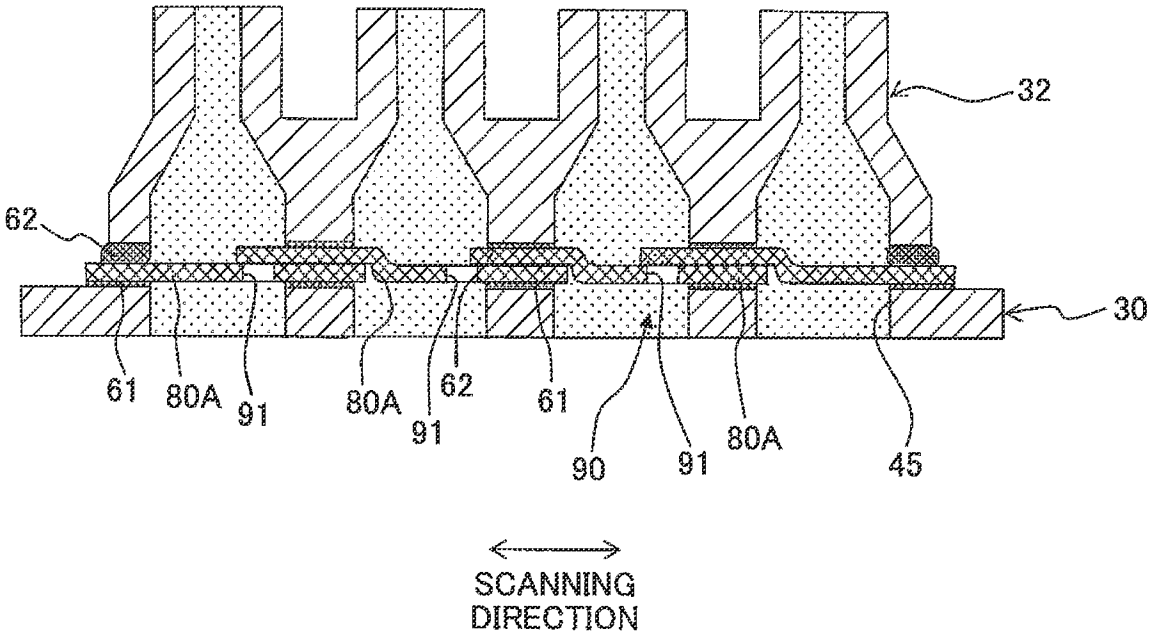
FIG. 14 is a cross-sectional view of other filters and the connecting member according to the third modification.

As depicted in FIG. 14, for example, between two adjacent filters 80A, one large through hole 91 is formed in the lower filter 80A in the overlap portion 90. Alternatively, instead of the through hole 91, a locally coarse-mesh portion may be provided in the filter 80A. By such kind of configuration, it is possible to keep down the flow resistance in the overlap portions 90 where the two filters 80A overlap.

<Fourth Modification>

In the above embodiment, the number of ink supply ports 45 of the channel unit 30 is equal to the number of filters 40, and the filter is provided individually for each of the plurality of ink supply ports 45. However, the present teaching is not limited to such a configuration. For example, one common filter may be provided for two or more ink supply ports 45. For example, in FIG. 3, the two left ink supply ports 45 may be covered by one filter, or the two right ink supply ports 45 may be covered by one filter.

<Fifth Modification>

In the above embodiment, the four filters 40 align in the scanning direction, and any two adjacent filters 40 overlap in the scanning direction. However, the present teaching is not limited to such a configuration. In a form of arranging a plurality of filters, it may be configured to have one overlap portion with three or more filters overlapping in one place.

<Sixth Modification>

In the above embodiment, in all places of any two adjacent filters 40 (three places in total) among the plurality of filters 40, the corresponding adjacent filters 40 overlap. However, the present teaching is not limited to such a configuration. It is also possible to adopt a configuration of overlapping the adjacent corresponding filters in only some of the adjacent places.

<Seventh Modification>

In the above embodiment, the outer shape of each filter 40 is approximately rectangular and, likewise, the shape of the portion of each filter 40 to form the plurality of holes is also approximately rectangular. However, the outer shape of each filter 40 and the shape of the portion of each filter 40 to form the plurality of holes are not limited to being both identical or similar but, for example, the outer shape of each filter 40 is approximately rectangular, whereas the shape of the portion of each filter 40 to form the plurality of holes may be circular. Alternatively, even if both the outer shape of each filter 40 and the shape of the portion of each filter 40 to form the plurality of holes are identical or similar, they are not limited to being approximately rectangular. For example, both the outer shape of each filter 40 and the shape of the portion of each filter 40 to form the plurality of holes may also be approximately circular.

<Eighth Modification>

Figure 15A:
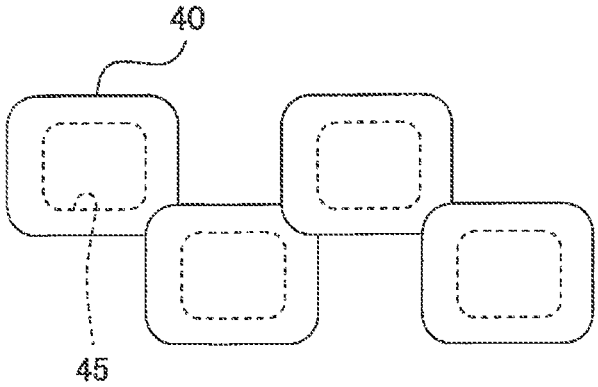
FIG. 15A is a plan view of filters and ink supply ports according to an eighth modification.
Figure 15B:
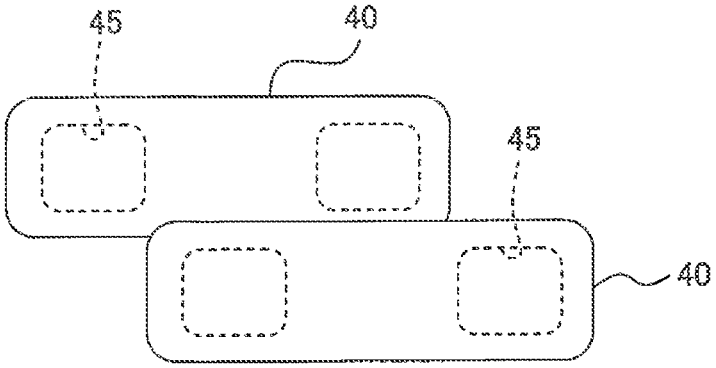
FIG. 15B is a plan view of other filters and ink supply ports according to the eighth modification.

In the above embodiment, while the four ink supply ports 45 of identical shape are arranged to align in one row, the present teaching is not limited to such a configuration. For example, among the four ink supply ports 45, at least one ink supply port 45 may be larger than the other ink supply ports 45. In such cases, it is possible to adjust the sizes of the filters 40 according to the sizes of the ink supply ports 45. Further, the diameter (mesh diameter, for example) of the plurality of holes of each filter 40, as well as the thickness of the filters 40, may be adjusted according to the sizes of the ink supply ports 45. Further, the four ink supply ports 45 need not necessarily be arranged to align in one row. As depicted in FIGS. 15A and 15B, for example, they may be arranged in a zigzag pattern. In such cases, as depicted in FIG. 15A for example, the filters 40 may be fitted individually to correspond respectively to the ink supply ports 45 on a one-to-one basis. Alternately, as depicted in FIG. 15B, two filters 40 may be arranged to collectively cover two ink supply ports 45 aligning every other.

Figure 16:
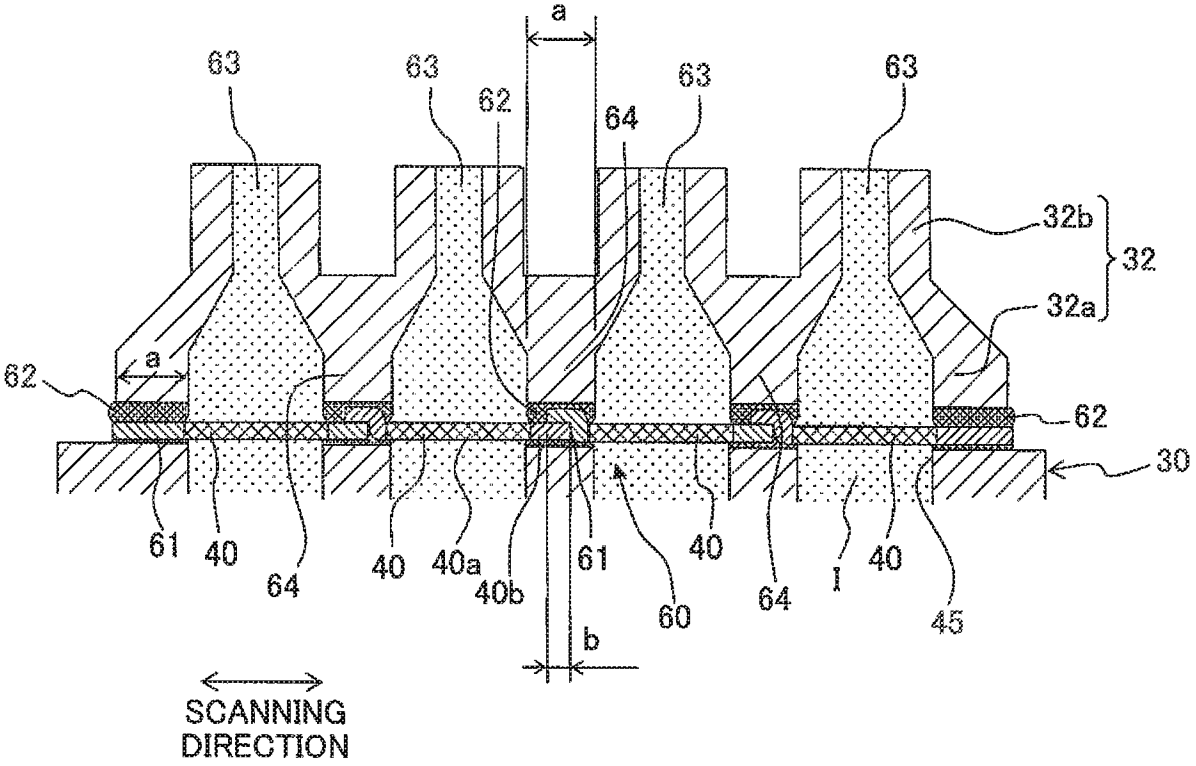
FIG. 16 is a cross-sectional view of another connecting member.

Further, in the embodiment and its modifications explained above, there are four ink supply ports 45 and four filters 40 in number. However, the present teaching is not limited to such configurations, but an arbitrary number not less than two may be set therefor, respectively. Further, as depicted in FIG. 5 for example, the base portion 32*a* of the connecting member 32 has thinner walls at both ends in the scanning direction than the width 'a' of the partition wall portions 64 in the scanning direction. However, the present teaching is not limited to such a configuration. As depicted in FIG. 16 for example, the base portion 32*a* of the connecting member 32 may have such walls at both ends in the scanning direction as thick as the width 'a' of the partition wall portions 64 in the scanning direction. In such a case, the filters 40 at both ends in the scanning direction may have the same shape as the other filters 40. Alternatively, as depicted in FIG. 16, the surrounding portions 40*b* of the filters 40 at both ends in the scanning direction may be provided to extend toward one side of the scanning direction.

Further, in the embodiment and its modifications explained above, the connecting member 32 is fitted on the filters 40 to have the four cylindrical connecting portions 32*b* projecting upward from the base portion 32*a* of the connecting member 32. However, in the present teaching, it is possible to change the shape of the connecting member 32 fitted on the filters 40 as appropriate whenever necessary. For example, the connecting member 32 may be shaped plate-like.

In the embodiment and its modifications explained above, the present teaching is applied to an ink jetting apparatus which jets inks to recording paper to print images and the like thereon. However, the present teaching may also be applied to any liquid jetting apparatus used for various purposes other than printing images and the like. For example, it is possible to apply the present teaching to liquid jetting apparatuses which jet an electrically conductive liquid to a substrate to form a conductive pattern on a surface of the substrate.

What is claimed is:

1. A liquid jetting apparatus configured to jet liquid, comprising:

a channel structure in which liquid channels including a plurality of nozzles are formed, and in one surface of which a plurality of supply ports are formed to communicate with the liquid channels; and a plurality of filters attached on the one surface of the channel structure to cover the plurality of supply ports;

wherein one of the plurality of filters is arranged to overlap, on the one surface of the channel structure, partially with another filter of the plurality of filters which is located adjacent to the one of the plurality of filters, at an area between the plurality of supply ports.

2. The liquid jetting apparatus according to claim 1, further comprising:

a channel-supply portion configured to supply the liquid to the channel structure; and a connecting portion connecting the channel-supply portion with the plurality of supply ports of the channel structure;

wherein the plurality of supply ports are arranged to align along a direction parallel to the one surface of the channel structure;

wherein the plurality of filters are arranged to align in the direction to individually cover the plurality of supply ports respectively, and the adjacent filters in the predetermined direction overlap partially with each other;

wherein the connecting portion includes a plurality of supply channels aligned in the direction to communicate respectively with the plurality of supply ports, and a plurality of partition wall portions partitioning the supply channels respectively;

wherein the partition wall portions are joined on overlap portions where the adjacent filters in the direction overlap with each other; and wherein a width of the partition wall portions the direction is greater than a width of the overlap portions in the direction.

3. The liquid jetting apparatus according to claim 1, further comprising:

wherein a recess or through hole is formed within an overlap portion, on the one surface of the channel structure, where the adjacent filters overlap with each other in at least one of the plurality of filters constituting the overlap portion.

4. The liquid jetting apparatus according to claim 3;

wherein within the overlap portion, the through hole is formed in each of all the plurality of filters constituting the overlap portion.

5. The liquid jetting apparatus according to claim 4;

wherein the plurality of through holes, which are formed respectively in the plurality of filters constituting the overlap portion, overlap partially with each other in a thickness direction of the filters.

6. The liquid jetting apparatus according to claim 1;

wherein each filter includes an opening portion configured to filter the liquid; the opening portions of the adjacent filters overlap partially with each other; and each overlap portion of the adjacent filters for the opening portions to overlap covers a partial area of the supply port.

7. The liquid jetting apparatus according to claim 6;

wherein among the partially of filters constituting the overlap portions, a part of the filters are configured to have, within the opening portions, a higher mesh coarseness of the area constituting the overlap portions than the mesh coarseness of the other area than that constituting the overlap portions.

8. The liquid jetting apparatus according to claim 1;

wherein the plurality of supply ports are arranged to align in a direction parallel to the one surface of the channel structure;

wherein the plurality of filters include a first filter and a second filter aligned alternately in the direction in accordance with the arrangement of the plurality of supply ports;

wherein the total number of first filter and the second filter is three or more; and wherein among the end portions of the first filter in the direction, all the end portions adjacent to the second filter ride on the second filter to overlap therewith.

9. The liquid jetting apparatus according to claim 1;

wherein the overlap portion on the one surface of the channel structure is thicker than the portion other than the overlap portion on the one surface of the channel structure.

10. The liquid jetting apparatus according to claim 1, further comprising:

a channel-supply portion configured to supply the liquid to the channel structure; and a connecting portion connecting the channel-supply portion with the plurality of supply ports of the channel structure;

wherein the connecting portion is joined on the overlap portion on the one surface of the channel unit.

* * * * *